United States Patent [19]

Amend

[11] 4,305,574

[45] Dec. 15, 1981

[54] QUENCHING DEVICE

[75] Inventor: Clifford L. Amend, Youngstown, Ohio

[73] Assignee: Ajax Magnethermic Corporation, Warren, Ohio

[21] Appl. No.: 697,354

[22] Filed: Jun. 18, 1976

[51] Int. Cl.[3] ..... C21D 1/62

[52] U.S. Cl. ..... 266/114; 134/122 R

[58] Field of Search ..... 266/111–114; 148/153; 134/64 R, 122 R

[56] References Cited

U.S. PATENT DOCUMENTS 2,616,437 11/1952 Secor ..... 266/113 X
2,623,531 12/1952 Waddington et al. ..... 266/113 X
3,148,093 9/1964 Williams et al. ..... 266/113 X
3,675,908 7/1972 Amend ..... 266/113 X

*Primary Examiner*—Paul A. Bell
*Attorney, Agent, or Firm*—J. Helen Slough

[57] ABSTRACT

An improved spray quenching device for quenching a relatively moving elongated workpiece such as steel pipe consisting of an improved quench means for directing a stream of quenchant at an acute angle to an elongated heated workpiece or pipe moving therethrough, means whereby the quenchant contacts the same in a relatively short time after heating and the quenchant is distributed thereby over a greater extent of the workpiece or pipe between the supports thereof.

1 Claim, 3 Drawing Figures

QUENCHING DEVICE

This invention relates to quench hardening a metal and, in particular, to an improved spray quenching device for quenching a relatively elongated workpiece such as steel pipe. The present invention is particularly adapted for use with induction heating of the elongated workpiece.

To harden elongated workpieces, an annular quench means has been used directing the quenchant on the material after it has been raised to hardening temperature. In order to achieve the best flow of the quenchant, and therefore faster cooling of the hot material, U.S. Pat. No. 3,675,908 dated July 11, 1972 to the present inventor have been granted which disclose a quench means provided with apertures disposed at an angle in a manner to afford a cone-shaped spray pattern, the apex of the cone being directed toward the exit end of the quench ring and directed at an acute angle to a workpiece moving therethrough. The quench ring as shown therein is of a somewhat larger inside diameter than the outside diameter of the workpiece being quenched in order that the flow pattern of the quenchant not be disturbed by the restriction of the annular space between the two. The physical length of this type of quench ring is also limited by the space between the conveyor rolls. Due to the fact that the pipe is hot when it emerges from the heating apparatus, its physical strength is substantially reduced, and hence supports or supporting rolls therefor may not be spaced too far apart.

In the Letters Patent to which I have referred hereinbefore, it will be noted that adjacent the exit end of the quench ring and spaced a short distance therefrom an elongated sleeve of cylindrical cross section is provided through which the workpiece travels. The angle of the conical spray pattern is such that a substantial amount of high-velocity spray directed from the quenching device upon the outer surface of the pipe ricochets or rebounds therefrom into the sleeve impinging upon the inner peripheral surfaces thereof, whereupon the spray is redirected back toward the outer surface of the pipe and said quenching device and sleeve enchances and increases the quenching power of a conventional quenching fluid and extends the quench.

The present invention as herein illustrated and described involves improvements over the quenching means of U.S. Pat. No. 3,675,908 dated July 11, 1972, and involves a delivery of the spray pattern on the relatively moving workpiece earlier in time than would be possible in the prior construction. It further allows quenching to take place over a greater percentage of the span of the pipe or moving workpiece disposed between supports therefor. A further improvement in the present invention is that the space and therefore the time between that point on the workpiece leaving the heating apparatus and that point where it first enters the quenching zone is also relatively shorter, which is particularly advantageous when the workpiece has a low weight/surface area ratio, for example, thin-walled tubing, or if the workpiece is to be surface-hardened only. In the former case, heat lost to the atmosphere before quenching tends to lower the overall temperature of the workpiece at a comparatively slow rate before it enters the quenching zone. In the second instance, heat lost to the colder core of the surface-heated material tends to have the same effect. The present invention discloses the use of a quenching device surrounding the workpiece wherein apertures in the device at the entry end are disposed relatively more closely adjacent to the workpiece than apertures at the exit end thereof.

The invention further, as herein illustrated and described, directs quenching fluid toward the workpiece at an acute angle to its direction of movement preventing any splashback into the heating apparatus; prevents pre-quenching from uncontrolled splashing back onto heated portions of the workpiece; prevents distortion from differential cooling; promotes rapid movement of the quenching fluid along the surface of the workpiece and prevents stagnation of the quenchant with consequent formation of vapor resulting in areas of "under quenching"; it further prevents quenching fluid from being propelled into the leading end of the hollow or tubular workpiece as it enters the quenching zone, preventing non-uniform quenching.

In view of the foregoing, the general object of the present invention is to enhance the quenching power of the quench ring and to adapt said quench ring to use with various size pipe.

Another object of the invention is to shorten the length of time in which quenching fluid from the quenching ring first contacts the workpiece as it is delivered from the heating zone.

Yet another object of the invention is to secure quenching over a greater percentage of the span between the supports in the quenching area.

Still another object is to provide a quenching device which is simple and economic to manufacture and highly durable in use.

Other objects of the invention will be readily apparent from the following description thereof and the accompanying drawings, in which drawings.

Figure 1:
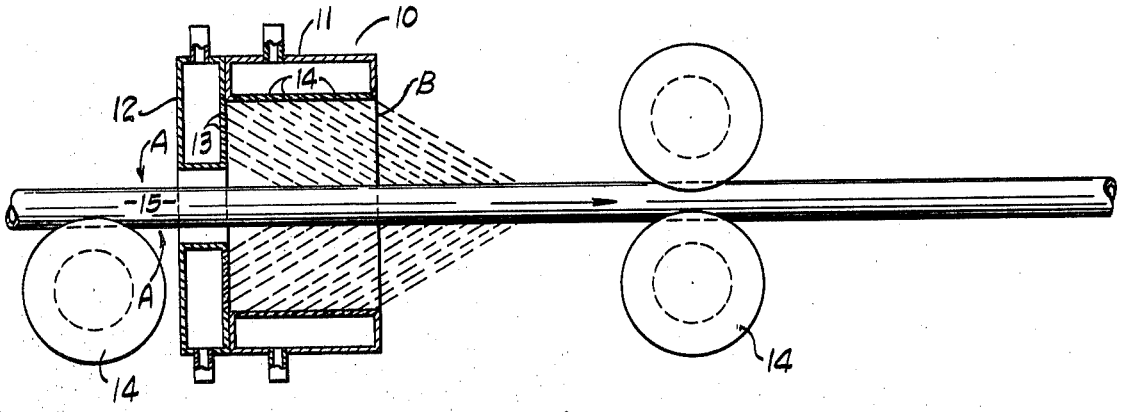
FIG. 1 is a longitudinal section through a first embodiment of the quenching device of this invention.

Referring now to the drawings in all of which like parts are designated by like reference numerals, the quenching device 10 of this invention as shown in the embodiment of FIG. 1 consists of two separate quench portions 11 and 12 in abutting engagement, said quench portion 11 being horizontally disposed in spaced substantially parallel relation to an elongated workpiece or pipe 15 passing through the same and the annular quench portion 12 being generally perpendicularly disposed to the direction of travel of the pipe and secured as by separate attachment means (now shown) or welding or the like to portion 11. The perpendicular portion 12 is provided with angled apertures 13 preferably of the same angle as angled apertures 14 of the quench portion 11. Both the quench ring portions 11 and 12 are of somewhat larger inside diameter than the outside diameter of the elongated workpiece or pipe being quenched in order that the flow pattern of the quenchant not be disturbed by restriction of the annular space between the quench ring and the pipe. The perpendicular portion 12 which may be referred to as a flat quench ring is mounted at the entry end A of the annular or cylindrical quench ring and the holes are drilled to present high velocity quenchant supplied thereto by an inlet pipe 16' from the reservoir portion 12 to the workpiece forwardly of and at the same angles as high velocity quenchant supplied by an inlet pipe 16 emitting from the holes in the cylindrical or annular ring reservoir 11.

The inside diameter of said flat or perpendicular portion of the quench ring is of less diameter than the inside diameter of the annular quench ring portion and only slightly larger than the diameter of the workpiece or pipe neing hardened. The quenchant from said flat portion 12 flows at an acute angle to the workpiece toward the larger discharge end B of the cylindrical quenching ring, and the quenchant from the annular quench 11 flows preferably at the same acute angle to the workpiece, wherefore the pattern of quench is the same from both portions 11 and 12. It is to be noted that the innermost or initially emitted streams of quenchant from the flat ring 12 contact the hot elongated workpiece nearer to the roll support 14 than the quenchant from the portion 11, thus allowing a greater time and distance for active quenching before the material reaches the exit rolls 15. It is to be noted that the quenching chamber at the discharge end B where the workpiece emerges from the quenching ring is of sufficient inside diameter not to restrict or distort the collective volume of quenching fluid passing through the annular space between it and the workpiece.

It is to be understood that the portions 11 and 12 are preferably separable so that, if desired, only the parallel annular ring portion could be used in the manner described in U.S. Pat. 3,675,908 to quench relatively larger pipes or workpieces passing therethrough.

Figure 2:
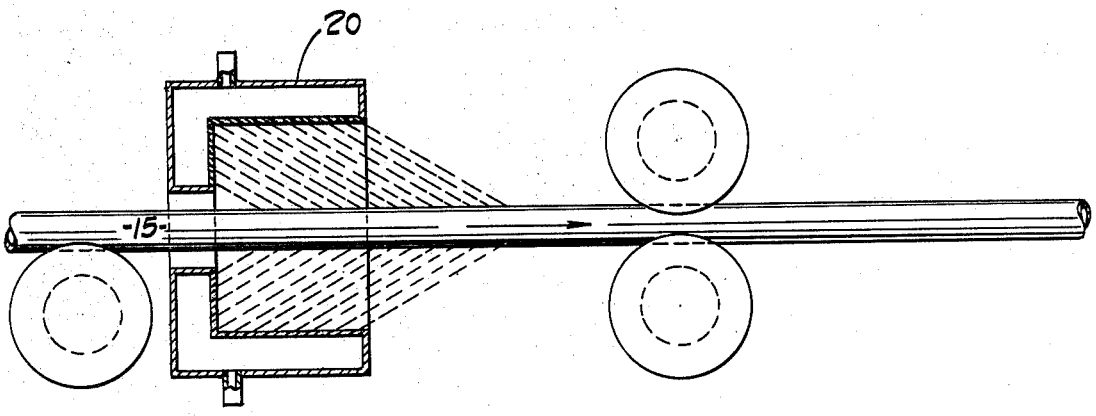
FIG. 2 is a longitudinal section through a second embodiment of the quenching device of this invention.

The quench ring 20 of FIG. 2 is constructed similarly to that of the quench ring of FIG. 1 but is, as shown, a one-piece integral quench construction and, hence, is applicable only to a relatively smaller range of sizes of workpieces or pipes.

Figure 3:
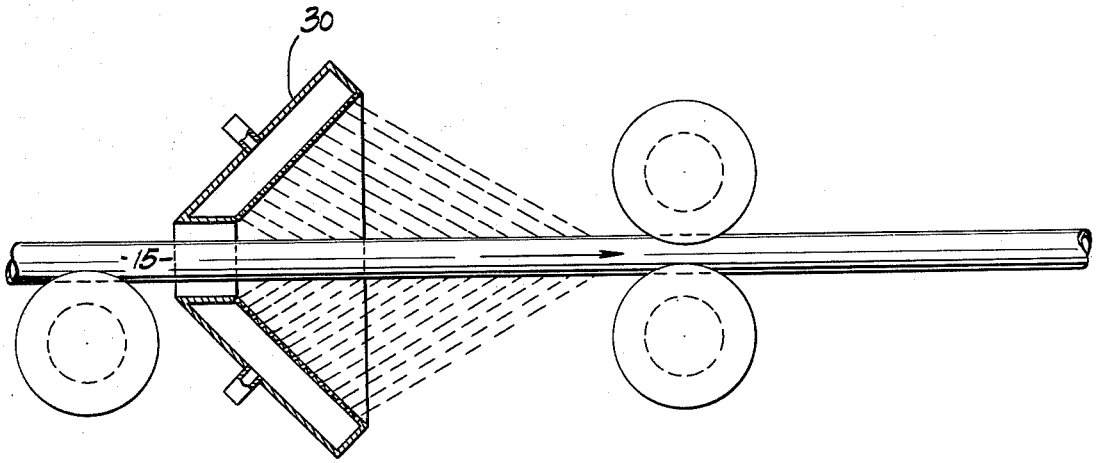
FIG. 3 is a longitudinal section through a third embodiment of the quenching device of this invention.

In the form of FIG. 3, the quench ring 30 is generally conical in cross section and the spray is directed conically toward the workpiece in progressively lengthened spray from the inner to the outer periphery of said device.

It will be noted that in each form of the invention the quenching ring has an inner diameter at the workpiece entry end which is less than the diameter at the workpiece exit end.

The quenchant spray directed on the workpiece or pipe according to this invention may be further extended by use of conical deflectors, as shown in copending application Ser. No. 697,380 filed June 18, 1976 or by the use of a sleeve as shown in U.S. Pat. No. 3,675,908 dated July 11, 1972 or any combination of the same.

It will be understood that many changes in the details of the invention as herein described and illustrated may be made, such as changes in shape, size, etc., without, however, departing from the spirit of my invention or the scope of the appended claims.

What I claim is:

1. A quenching device for quenching an elongated, relatively moving steel pipe workpiece, said device open at both ends surrounding said workpiece and spaced therefrom and having a source of high-velocity fluid supplied thereto, said device having a plurality of apertures disposed in a substantially even distribution over the inner surface thereof, the apertures in said device disposed adjacent the entry end for the workpiece being disposed relatively more closely adjacent the workpiece that the apertures adjacent the exit end thereof, all said apertures being disposed to direct streams of quenching fluid toward the surface of said workpiece at an acute angle to the direction of travel thereof, the apertures at the exit end adapted to deflect streams of quenching fluid outwardly and substantially beyond the exit end of the quenching device, said device having a horizontally extending annual quenchant reservoir portion having angled apertures therein about its inner periphery and a perpendicularly extending annular quenchant reservoir having angled apertures therein on a lateral side thereof adjacent to the inner periphery of said first annular portion wherefrom a conical spray is directed at an acute angle to the workpiece moving therethrough, said perpendicularly extending annular quenchant reservoir being detachably secured to said horizontally extending reservoir portion.

* * * * *

UNITED STATES PATENT AND TRADEMARK OFFICE

CERTIFICATE OF CORRECTION

PATENT NO. : 4,305,574

DATED : December 15, 1981

INVENTOR(S) : Clifford L. Amend

It is certified that error appears in the above-identified patent and that said Letters Patent is hereby corrected as shown below:

Column 2, line 54, "(now shown)" should read ---(not shown)---

Column 3, line 11, "neing" should read ---being---.

Signed and Sealed this

*Third* Day of *August 1982*

[SEAL]

*Attest:*

GERALD J. MOSSINGHOFF

*Attesting Officer* *Commissioner of Patents and Trademarks*